US011072473B2

(12) United States Patent
Rossi

(10) Patent No.: US 11,072,473 B2
(45) Date of Patent: Jul. 27, 2021

(54) FLIP-TOP TUBE WITH TAMPER-EVIDENT SEAL

(71) Applicant: GFL S.A., Lugano (CH)

(72) Inventor: Luigi Rossi, Lugano (CH)

(73) Assignee: GFL S.A., Lugano (CH)

( * ) Notice: Subject to any disclaimer, the term of this patent is extended or adjusted under 35 U.S.C. 154(b) by 112 days.

(21) Appl. No.: 16/170,678

(22) Filed: Oct. 25, 2018

(65) Prior Publication Data

US 2019/0127133 A1 May 2, 2019

(30) Foreign Application Priority Data

Oct. 27, 2017 (IT) ..... 102017000122710

(51) Int. Cl.

| | |
|---|---|
| ***B65D 55/06*** | (2006.01) |
| ***B65D 35/44*** | (2006.01) |
| ***B65D 47/08*** | (2006.01) |
| ***B65D 51/18*** | (2006.01) |

(52) U.S. Cl.

CPC ..... *B65D 55/06* (2013.01); *B65D 35/44* (2013.01); *B65D 47/0838* (2013.01); *B65D 47/0842* (2013.01); *B65D 51/185* (2013.01)

(58) Field of Classification Search

CPC ..... B65D 55/0818; B65D 55/0827; B65D 51/185; B65D 55/06; B65D 55/0809; B65D 23/085; B65D 23/0878; B65D 35/44; B65D 2401/05

See application file for complete search history.

(56) References Cited

U.S. PATENT DOCUMENTS

| | | | | |
|---|---|---|---|---|
| 4,564,115 | A | 1/1986 | Imbert | |
| 4,964,513 | A | 10/1990 | Ingram et al. | |
| 5,048,711 | A | 9/1991 | Weiss et al. | |
| 5,209,795 | A * | 5/1993 | DeRosa | B29C 65/7847 156/475 |
| 5,967,384 | A | 10/1999 | Mengeu et al. | |
| 7,398,890 | B2 * | 7/2008 | Thomson | B65D 49/04 215/21 |
| 8,381,925 | B2 * | 2/2013 | Skillin | B65D 55/0818 206/459.5 |
| 2016/0023818 | A1 | 1/2016 | Gelov et al. | |

FOREIGN PATENT DOCUMENTS

| | | | |
|---|---|---|---|
| CN | 1260101 | C | 6/2006 |
| CN | 103619717 | A | 3/2014 |
| CN | 105473460 | A | 4/2016 |
| FR | 2 571 027 | A1 | 4/1986 |
| FR | 2 731 983 | A1 | 9/1996 |

(Continued)

OTHER PUBLICATIONS

Italian Search Report for corresponding Italian Patent Application No. 102017000122710 dated May 31, 2018, 7 pages.

(Continued)

*Primary Examiner* — Andrew T Kirsch
(74) *Attorney, Agent, or Firm* — Merchant & Gould P.C.

(57) ABSTRACT

A flip-top tube (1), for example for cream, includes a tubular body (2) having a mouth (22), a cap (18) having a tab (70), and a label film (4) which at least partially wraps the tubular body and covers the tab (70) of the cap (18) to form a tamper-evident seal suitable for indicating the first opening of the tube.

12 Claims, 5 Drawing Sheets

(56) References Cited

FOREIGN PATENT DOCUMENTS

| | | | |
|---|---|---|---|
| JP | H03-14466 | A | 1/1991 |
| JP | 2002-162909 | A | 6/2002 |
| JP | 2009-204946 | A | 9/2009 |
| JP | 2017-43375 | A | 3/2017 |
| WO | 98/55984 | A1 | 12/1998 |
| WO | 2015/193670 | A1 | 12/2015 |

OTHER PUBLICATIONS

Chinese Office Action for Chinese Patent Application No. 201811258784.2 dated Mar. 30, 2021, 7 pages.

* cited by examiner

FLIP-TOP TUBE WITH TAMPER-EVIDENT SEAL

This application claims benefit of Serial No. 102017000122710, filed 27 Oct. 2017 in Italy and which application is incorporated herein by reference. To the extent appropriate, a claim of priority is made to the above disclosed application.

BACKGROUND OF THE INVENTION

The present invention is in the field of plastic tubes for the containment of products such as creams, pastes, thick liquids and the like.

Such tubes have a very low production cost and an enormous practicality of use; in effect, for dispensing the product, it is sufficient to squeeze the tube until the desired amount of substance has been dispensed.

Such tubes have countless uses and are particularly appreciated for containing cosmetic products, such as creams for skin or make-up, or for hygiene, such as shampoos, bath foams, and the like.

Such tubes typically have two types of closure: by means of a cap applicable to the head of the tube by screwing and by means of a cap integral with the head, which may be rotated and snap-locked thereon. The latter type is usually called "flip-top" and is for example illustrated in the document FR 2731983.

SUMMARY OF THE INVENTION

In particular, the present invention refers to the sector of plastic tubes with flip-top closure, equipped with a tamper-evident seal that reveals the first opening of the tube.

In particular, the present invention aims to create a plastic tube with flip-top closure that is equipped with a particularly efficient tamper-evident seal, i.e., such as to clearly reveal that the tube has been opened, and is particularly economical to make.

BRIEF DESCRIPTION OF THE DRAWINGS

The features and advantages of the tube according to the present invention will be apparent from the description given below, provided by way of non-limiting example, in accordance with the accompanying figures, wherein.

DETAILED DESCRIPTION OF THE PREFERRED EMBODIMENTS

Figure 3:
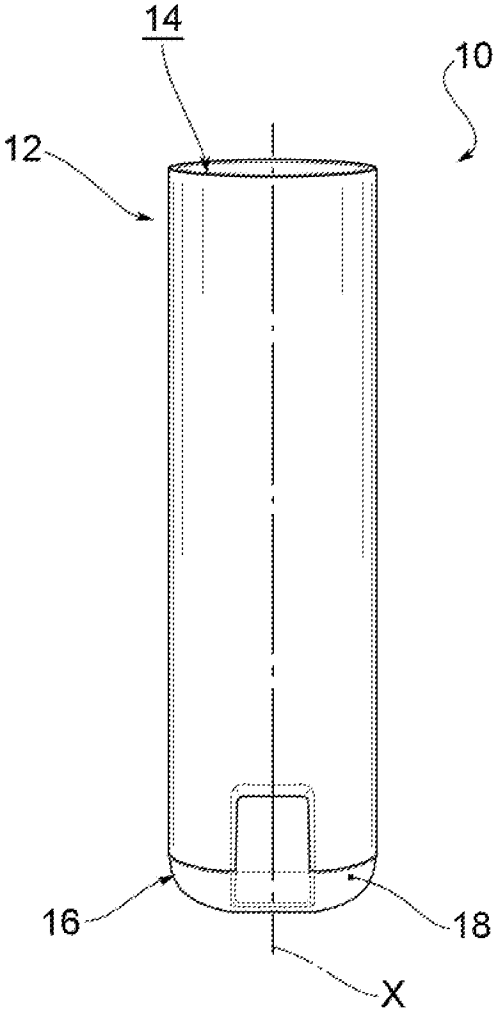
FIG. 3 shows a semi-finished tube from which the finished tube in FIG. 1 is derived.
Figure 2:
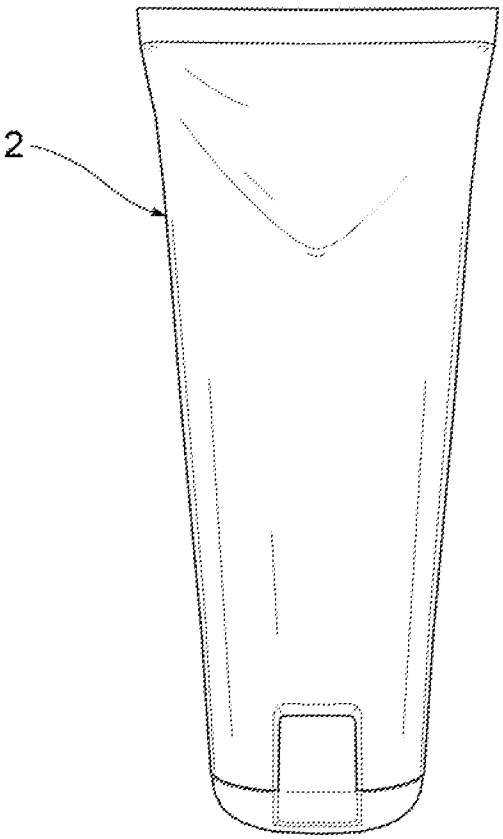
FIG. 2 represents the tube of FIG. 1 without label film.
Figure 1:
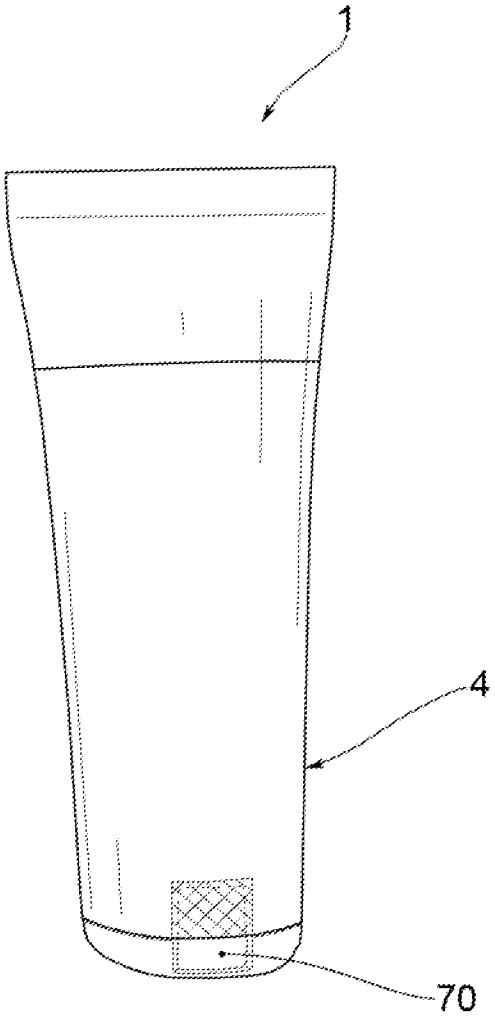
FIG. 1 shows a finished tube, according to an embodiment of the present invention, in a closed configuration, with an intact tamper-evident seal.
Figure 4:
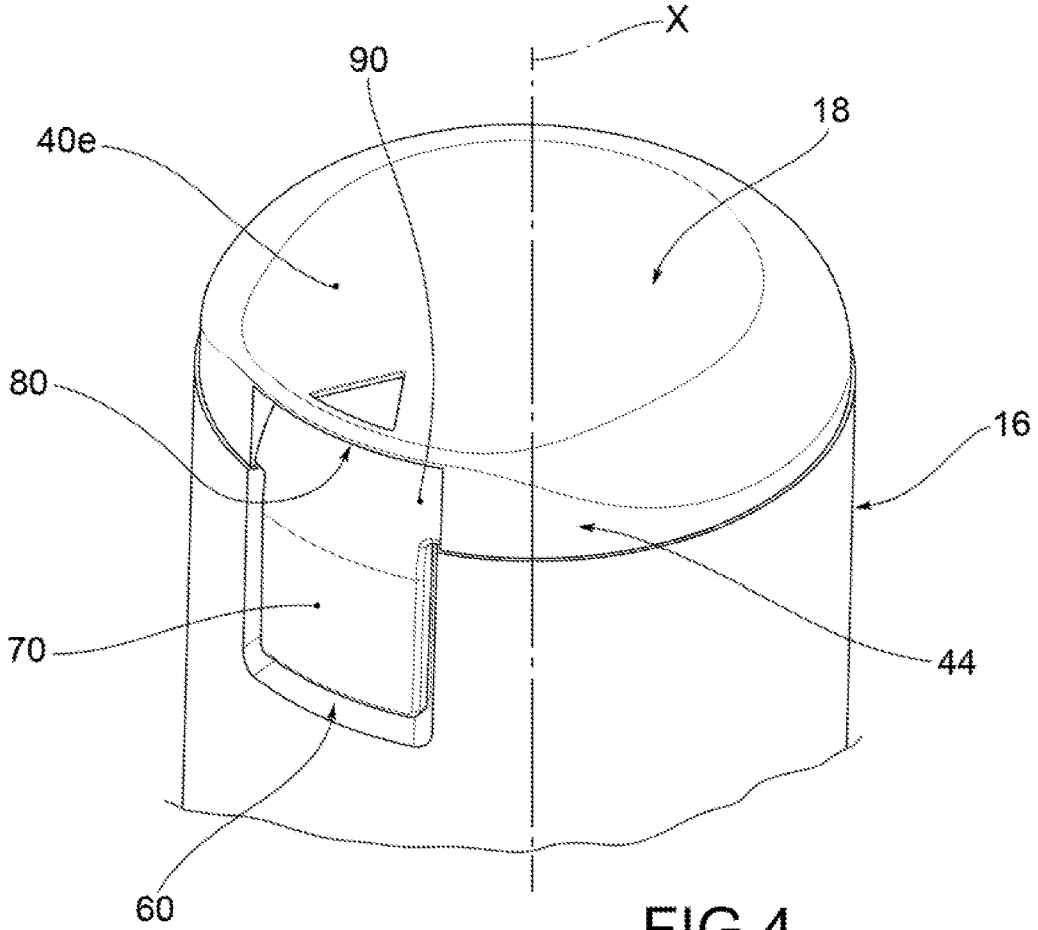
FIG. 4 shows a tube head of FIG. 1 in a closed configuration.
Figure 6:
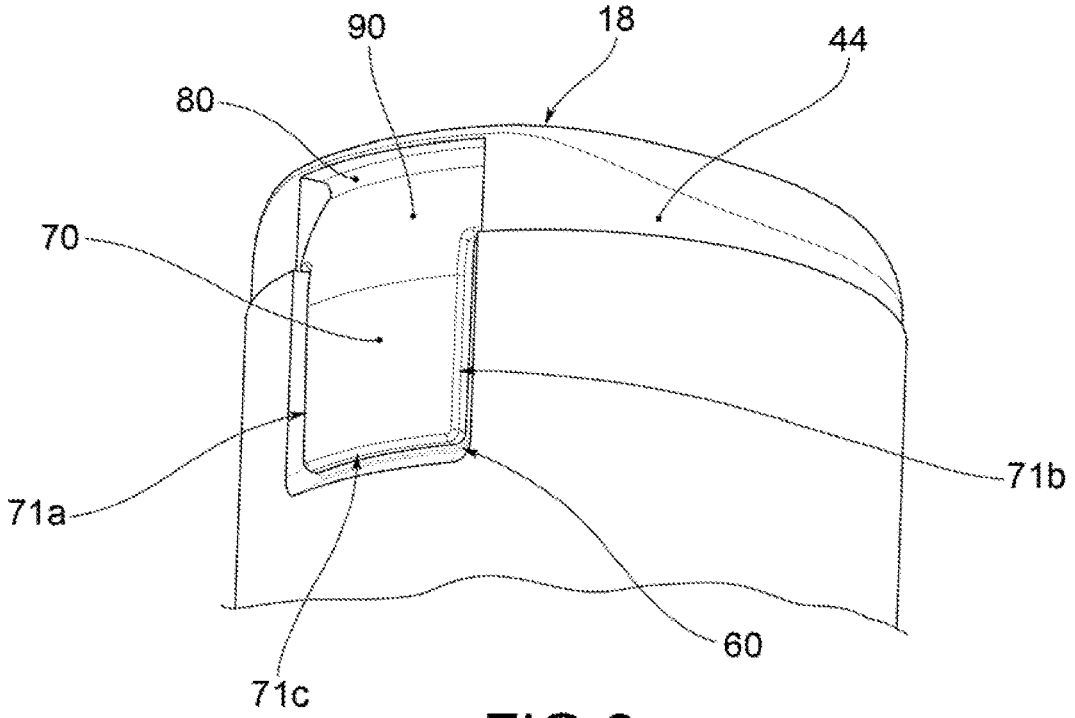
FIG. 6 represents a further view of the tube head of FIG. 1, in the closed configuration.
Figure 5:
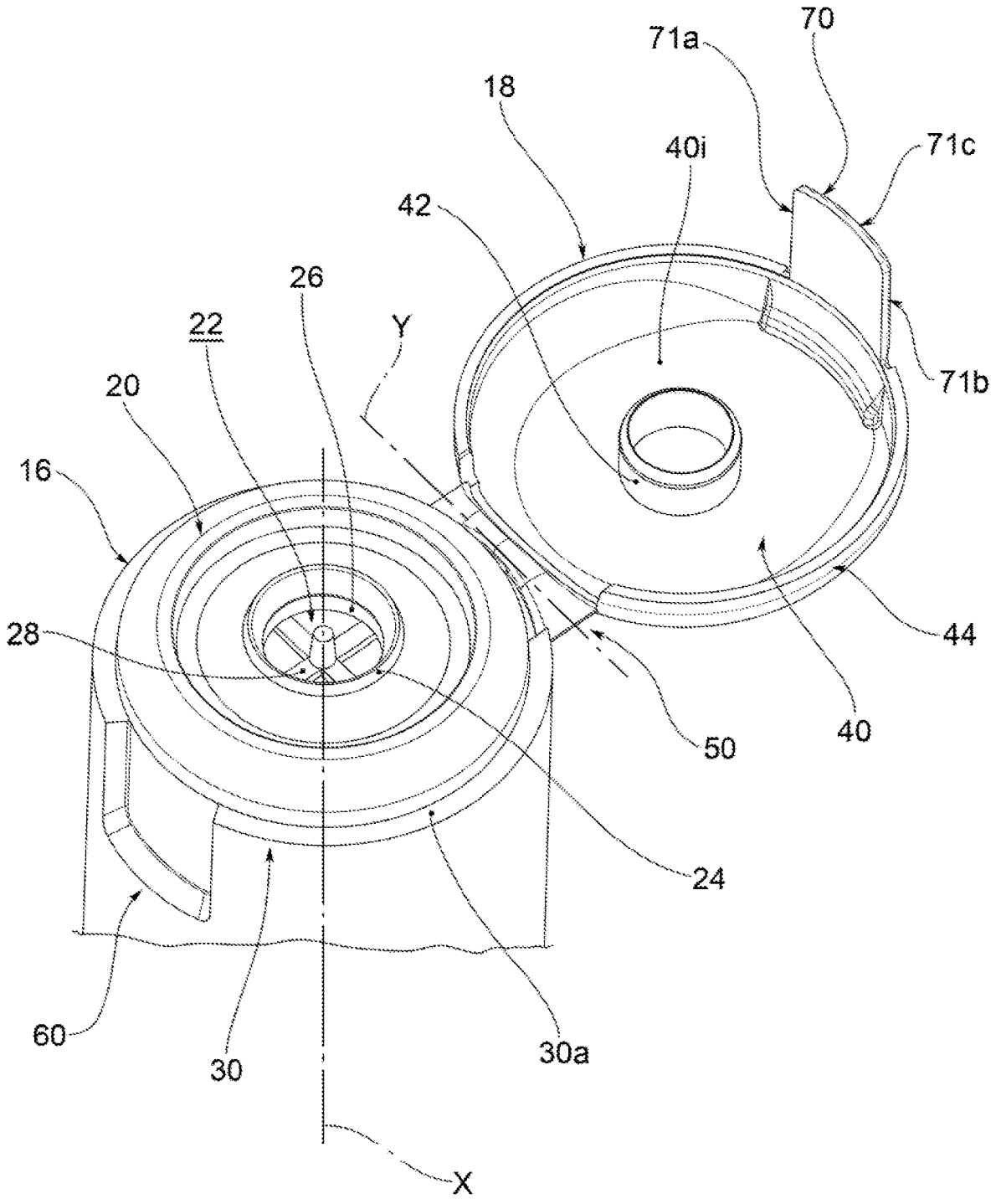
FIG. 5 shows the tube head of FIG. 4, in an open configuration.

With reference to the accompanying figures, a finished tube, intended for the containment and dispensing of a product, typically a cream, a paste product or a thick liquid, is wholly indicated at 1.

The finished tube 1 comprises a tubular body 2 and a label film 4, applied to the outer side surface of the tubular body, for example, wrapped around it.

The tubular body 2 is preferably made of a single piece of plastic material, starting with a semi-finished tube 10.

The semi-finished tube 10 is preferably obtained by means of injection molding and has a cylindrical shape along a main axis X, between an open end 12, which has an opening 14, and an opposite end 16, closed by a cap 18, which will be discussed below.

Typically, the label film 4 is first applied to the semi-finished tube 10, and then filled with a product through the opening 14. Finally, the open end 12 is closed, usually by welding the peripheral edge of the opening 14, squeezed to form two straight lines, and sometimes folded.

At the end 16, the tubular body 2 has a head 20 that closes said end 16 except for a mouth 22, usually in a central position.

Preferably, the mouth 22 is delimited annularly by a mouth wall 24, provided with an inner annular undercut 26.

Preferably, moreover, the mouth 22 has a septum 28, for example cross-shaped, to limit the passage section of the product when it is dispensed.

Moreover, preferably, the head 20 has an annular support for the cap 18, arranged peripherally, having a crown-shaped support surface 30*a*, substantially lying on an imaginary plane perpendicular to the main axis X.

The cap 18 is equipped with a bottom wall 40, preferably flat, with an inner surface 40*i* and an outer surface 40*e* which, in a closed configuration, is exposed to the outside.

Preferably, moreover, the cap 18 comprises an annular tang wall 42, protruding from the inner surface 40*i*, suitable to sealingly engage with the mouth wall 24; for example, in the closed configuration, the tang wall 42 fits into the mouth wall 24, creating a seal for the product that will be contained in the tube, snap-engaging with the undercut 26.

The cap 18 further comprises an annular side wall 44, which protrudes from the bottom 40 and surrounds it.

The cap 18 is joined to the tubular body 2 by means of a hinge 50, consisting of a thin membrane, which allows said cap to be folded over around a hinge axis Y tangent to the tubular body 2.

The head 20 preferably further provides for a longitudinal slot 60, for example rectangular in shape, arranged on the outer surface of the tubular body 2 and having a predefined axial extension. In particular, the slot 60 is positioned along the annular support 30 of the head 20.

Preferably, the slot 60 is arranged in a predefined angular position, diametrically opposed to the hinge 50.

Likewise, the cap 18 comprises a tab 70, preferably of the same shape as the slot 60, protruding from the peripheral edge of the side wall 44.

For the tab 70, sides 71*a*, 71*b* are defined, which delimit it circumferentially, and a base 71*c* which forms the free axial edge.

When the cap 18 is in the closed configuration wherein it closes the mouth 22, the tab 70 is lodged, at least partially and preferably with play, in the slot 60 of the head 20.

According to a preferred embodiment, moreover, the cap 18 comprises a step 80, made in undercut with respect to the outer surface 40*e* of the bottom wall 40, preferably at the tab 70.

For example, said step 80 has a predefined circumferential extension equal to that of the tab 70.

Preferably, moreover, at said step 80, the side wall 44 of the cap 18 has a connection surface 90, in the form of a recessed groove, which connects the step 80 with the tab 70.

The label film 4 is applied to the tubular body 2 in such a way as to overlap, at least partially, the tab 70, possibly accommodated in the slot 60.

Figure 7:
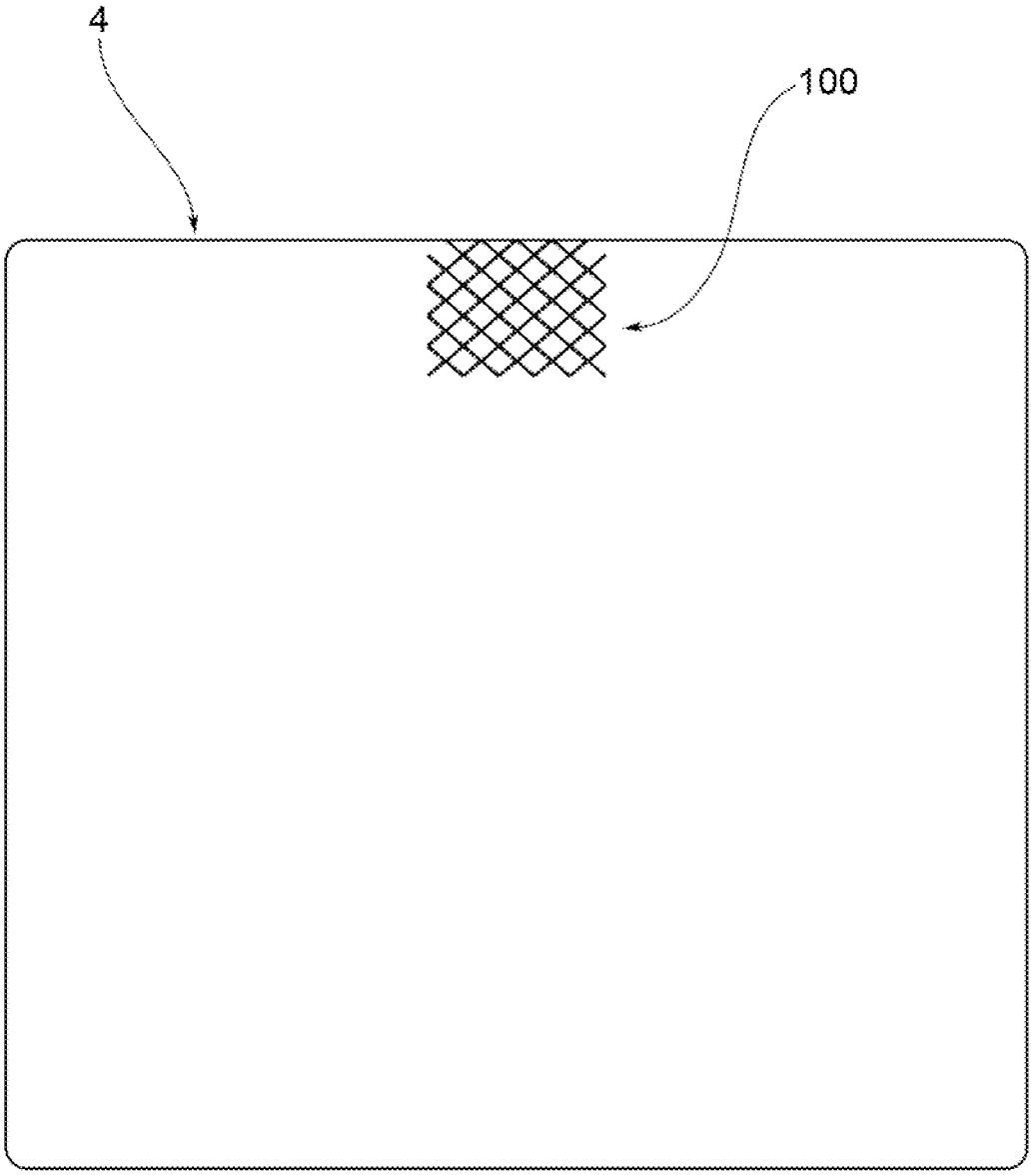
FIG. 7 shows a label film with a weakened portion.

For example, said label film consists of a typically rectangular polyethylene film (FIG. 7), preferably provided with a weakened region 100, for example, weakened by notches.

When the label film 4 is applied to the tubular body 2, the weakened region 100 has a predefined circumferential extension; according to a variant embodiment, however, the weakened region extends over the entire circumference of the tubular body (and therefore for the entire width of the film that constitutes the label film).

In addition, according to an illustrated embodiment, the label film 4 has an axial extension such as to end near the end of the tubular body 2 closed by welding. According to a variant embodiment, the label film extends axially only for a limited length, so that it has the shape of a ribbon.

Moreover, according to the illustrated embodiment, the weakened region 100 is unique. According to a variant embodiment, on the other hand, the label film comprises a plurality of weakened regions, for example, juxtaposed, for example, positioned at the sides 71*a*, 71*b* of the tab 80 or at the base 71*c* thereof, externally or internally to the same tab.

In addition, according to the illustrated embodiment, the label film completely wraps the lateral surface of the tubular body. According to a variant embodiment, however, the label film is applied only to a defined region of the side surface of the tubular body.

When the label film 4 is applied to the tubular body 2, the weakened region 100 is positioned at the tab 70.

For example, according to a preferred embodiment, the weakened region 100 extends above the tab 70 and on the side surface of the tubular body surrounding the tab 70, adjacent to the sides 71*a*, 71*b* and/or the base 71*c* thereof.

According to one variant embodiment, the weakened region extends only to the tab; according to another variant, the weakened region extends only to the side surface of the tubular body around the tab, at the sides 71*a*, 71*b* and/or the base 71*c* thereof.

Figure 8:
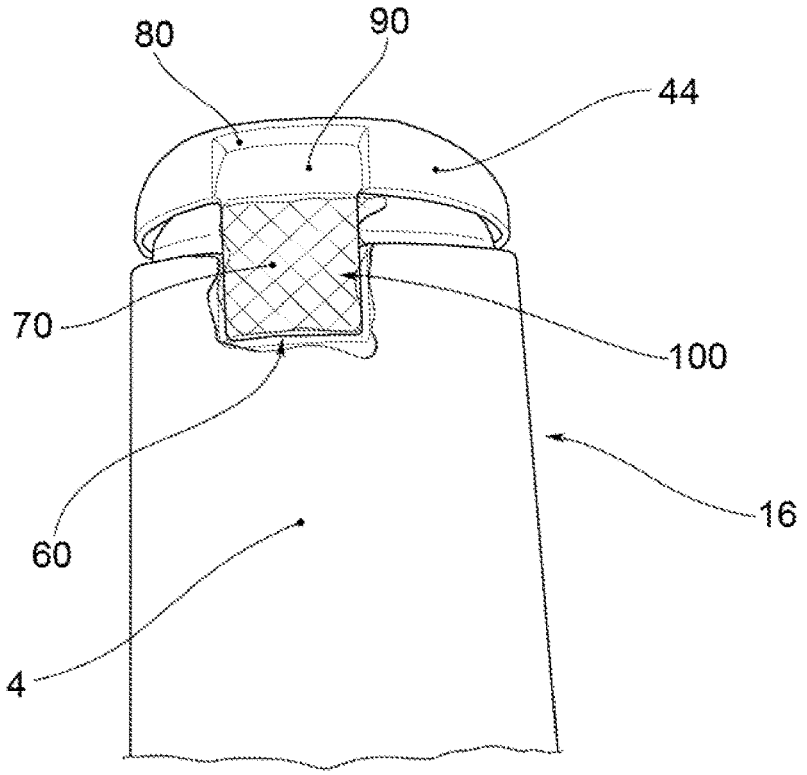
FIG. 8 shows the tube head in an open configuration.
Figure 9:
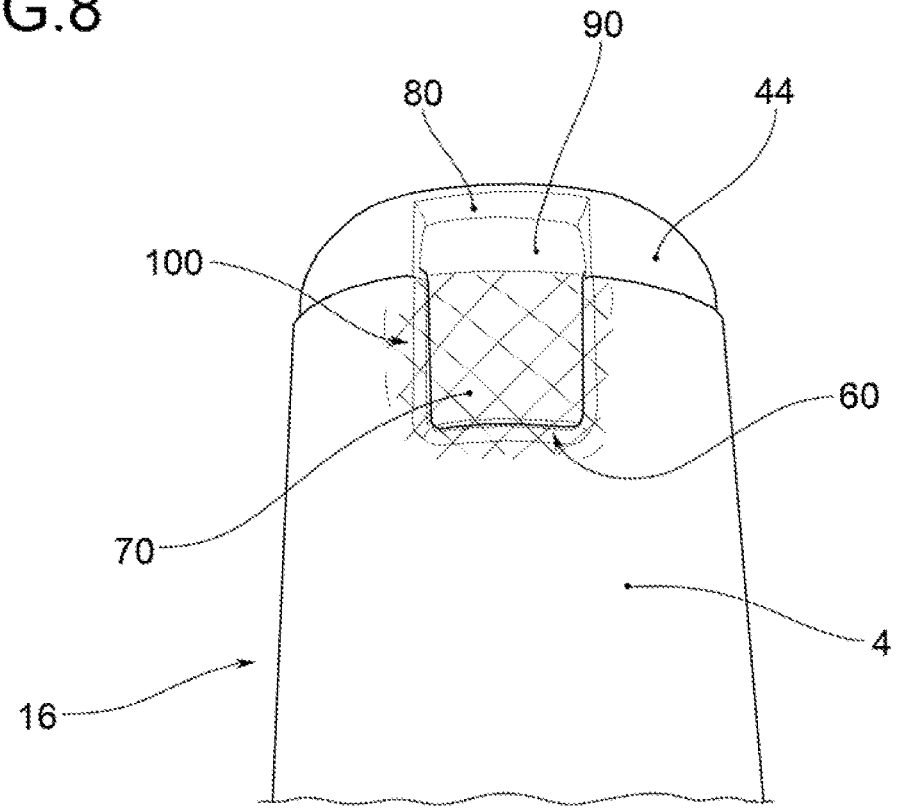
FIG. 9 shows the tube head in a closed configuration with the tamper-evident seal broken.

In any case, according to the illustrated embodiment, starting with the intact tube 1, lifting the cap 18, for example, by pressing with a finger against the step 80, the weakened region 100 is ripped or torn (FIG. 8), so that, when the cap is closed, the first opening of the tube is evident (FIG. 9).

In other words, the tab 70 of the cap 18 and the weakened region 100 of the label film 4 constitutes a tamper-evident seal for the tube 1.

According to a further embodiment of the invention, the label film 4 has no weakened region, but nevertheless a region around the tab is ripped or torn at the opening of the cap because of the intrinsic resistance of the film that composes the label film.

According to a still further embodiment, the label film is not torn when the cap is opened, and the tab, during the opening of the cap, slips out from under the label film. Also in such case, a tamper-evident seal is created, since, by closing the cap, a portion of the label film remains under the tab, making it clear that the first opening of the tube has taken place.

Innovatively, the tube according to the present invention is equipped with a "flip-top" cap with a tamper-evident seal, particularly reliable in keeping track of the first opening of the tube and particularly easy to make.

In effect, the cap does not present any particular production difficulties and the label film would still be applied to the tube as is already done to provide the name of the product, brands and other important information.

It is clear that one skilled in the art, in order to meet contingent needs, may make changes to the tube described above, all contained within the scope of protection defined by the following claims.

The invention claimed is:

1. A flip-top tube comprising:

a tubular body having a mouth at a first end and the tubular body being welded at an opposite second end, the first end of the tubular body having a longitudinal slot;

a cap mounted to the tubular body at the first end, the cap having a side wall and a tab protruding from the side wall, the tab defining circumferential first and second sides, wherein the slot houses the tab when the cap is closed; and a label film which at least partially wraps the tubular body and covers the tab of the cap to form a tamper-evident seal for indicating a first opening of the tube;

wherein the label film comprises structurally weakened regions including a structurally weakened region proximate the first side of the tab and a structurally weakened region proximate the second side of the tab, and wherein when the cap is opened, the structurally weakened region creates at least one local rip or tear.

2. The tube according to claim 1, wherein the weakened regions comprise structurally weakened scored portions.

3. The tube according to claim 2, wherein the weakened regions are applied only on the tab.

4. The tube according to claim 2, wherein the weakened regions are applied only on regions of a lateral surface of the tubular body surrounding the tab.

5. The tube according to claim 2, wherein the weakened regions are applied on the tab and on regions of a side surface of the tubular body surrounding the tab.

6. The tube according to claim 2, wherein the weakened regions have circumferentially a limited extension.

7. The tube according to claim 2, wherein the weakened regions extend circumferentially over the label film.

8. The tube according to claim 2, comprising a plurality of circumferentially juxtaposed weakened regions.

9. The tube according to claim 8, wherein weakened regions are arranged adjacent to sides of the tab and a base of the tab.

10. The tube according to claim 1, wherein the cap has a step, undercut with respect to an outer surface of a bottom wall of the cap proximate the tab.

11. The tube according to claim 10, wherein the cap has a connection surface between the tab and the step, embedded and formed as a groove, to facilitate engagement with the step.

12. The tube according to claim 1, wherein the first and second sides of the tab and edges of the slot form a recess aligned with the structurally weakened regions between an edge of the slot and the sides of the tab.

* * * * *